United States Patent [19]

Mattson

[11] 4,402,106

[45] Sep. 6, 1983

[54] BLOWER ATTACHMENT FOR CLEANING RAIN GUTTERS

[75] Inventor: Charles A. Mattson, Chatsworth, Calif.

[73] Assignee: Allegretti & Company, Chatsworth, Calif.

[21] Appl. No.: 296,428

[22] Filed: Aug. 26, 1981

[51] Int. Cl.[3] ..... A47L 5/00

[52] U.S. Cl. ..... 15/406; 15/410

[58] Field of Search ..... 15/405, 415 R, 414, 15/410, 406

[56] References Cited

U.S. PATENT DOCUMENTS

| | | | |
|---|---|---|---|
| 2,623,234 | 12/1952 | Brown | 15/410 X |
| 3,041,655 | 7/1962 | Entler | 15/236 R X |
| 3,626,542 | 12/1971 | Despain et al. | 15/236 R |
| 3,971,098 | 7/1976 | Davis | 15/410 |
| 4,121,230 | 10/1978 | Feiner | 15/410 X |

*Primary Examiner*—Chris K. Moore

*Attorney, Agent, or Firm*—Fulwider, Patton, Rieber, Lee & Utecht

[57] ABSTRACT

A tubular attachment for portable air blowers to allow the cleaning of rain gutters and the like, wherein flowing air is conducted from the blower upwardly to approximately the height of the gutter, turned horizontally to pass over the gutter lip and then turned downwardly into the gutter trough to blow out leaves, twigs and other debris. The blown air is directed into the gutter through an adjustable elbow arrangement in which a terminal section of the elbow is rotatable with respect to an inner section of the elbow to allow the angle of air flow to be varied, so that cleaning may be accomplished from left-to-right or right-to-left along the gutter.

3 Claims, 5 Drawing Figures

Fig. 5
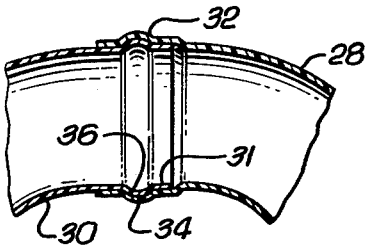
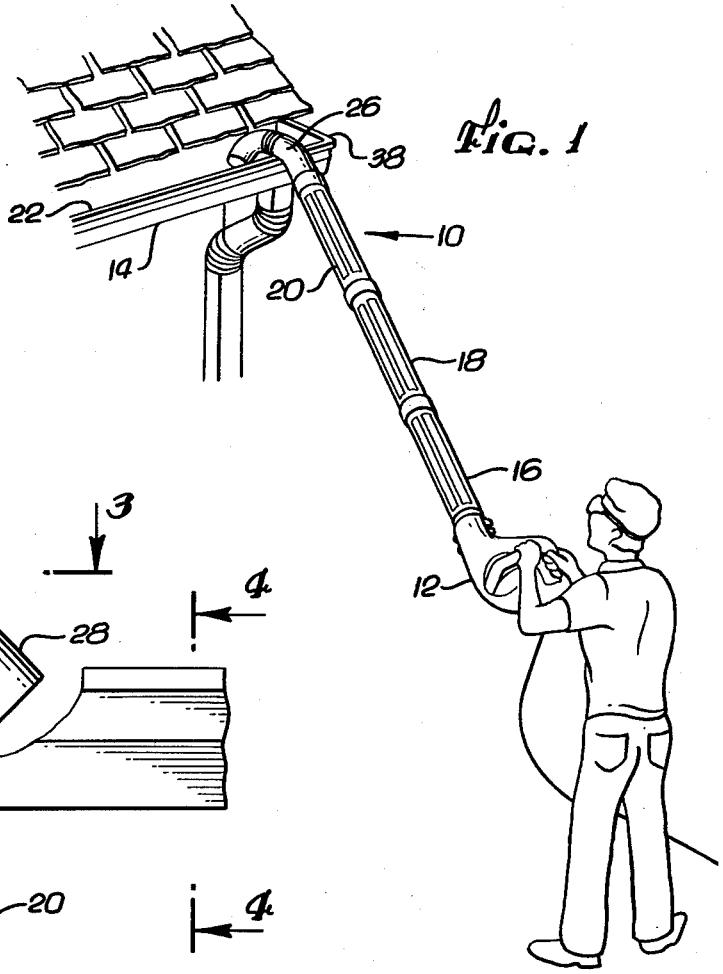
Fig. 1
Fig. 2
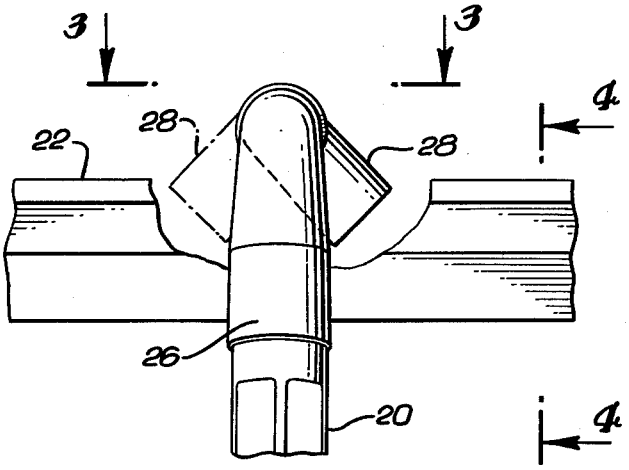
Fig. 3
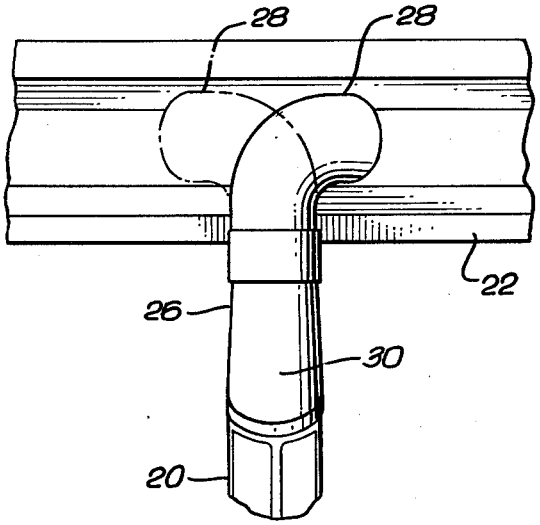
Fig. 4
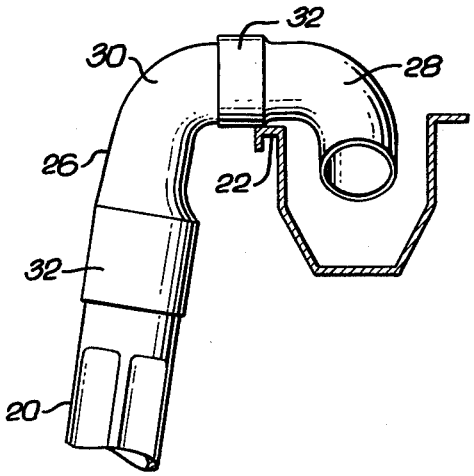

detailed description, taken in conjunction with the accompanying drawings, which illustrate, by way of example, the principles of the invention.

BRIEF DESCRIPTION OF THE DRAWINGS

The accompanying drawings illustrate embodiments of the invention. In such drawings:

FIG. 1 is a perspective view of a person cleaning a gutter, illustrating use of a blower attachment embodying the features of this invention;

FIG. 2 is an enlarged fragmented front elevation view of the blower attachment of FIG. 1, and illustrating an alternative operating position for the blower attachment by broken lines;

FIG. 3 is an enlarged, fragmented top plan view taken generally on the line 3—3 of FIG. 2;

FIG. 4 is an enlarged, fragmented side elevational view taken generally on the line 4—4 of FIG. 2; and FIG. 5 is an enlarged fragmented detail view of the rotation joint connecting the inner and terminal elbow sections of the blower attachment.

DETAILED DESCRIPTION OF THE PREFERRED EMBODIMENT

As is shown in the drawings for purposes of illustration, the present invention is embodied in a blower attachment, indicated generally by the numeral 10, for use with a hand-held air blower 12, which produces a high-velocity air stream to be directed by a person standing at ground level into an elevated rain gutter 14 for cleaning leaves, twigs and other debris therefrom. Such air blowers typically may be powered by gasoline or electricity. The flowing air is conducted to approximately the height of the gutter 14 by the blower attachment 10, which herein includes a series of three generally straight, hollow tubular extensions 16, 18 and 20 joined end-to-end. In this instance, one end of each extension 16, 18 and 20 is slightly tapered in order to form a friction-fit joint with the adjacent extension, as well as with the air blower 12.

In accordance with the present invention, the stream of flowing air is conducted over a lip 22 of the gutter 14 and then downward into a trough 24 of the gutter 14 to blow out leaves, twigs, and other debris, by an adjustable elbow 26 attached to the upper end of the extension 20, so that an operator standing on the ground may safely and efficiently clean the gutter trough 24. To allow the operator to clean in either direction along the gutter and to select the angle at which the air flow leaves the elbow 26 to best remove debris, the portion of the elbow 26 which directs air downwardly into the trough 24 is adjustably connected to the portion of the elbow 26 which conducts the air flow over the lip 22.

More specifically, and as illustrated for a preferred embodiment, the elbow 26 is attached to the end portion of the upper extension tube 20, and herein comprises two curved sections 28 and 30 connected together to permit the terminal section 28 to be rotated relative to the inner section 30, thereby permitting an adjustment in the direction of the air flow from the elbow 26 into the trough 24.

As can best be seen in FIG. 4, the inner section 30 is connected to the upper extension 20 by an enlarged flange portion 32 which is friction fit with the end portion of the extension 20 to secure the two together.

In order to direct the flow of air over the lip 22 of the gutter 14, the inner section 30 is curved so that the air flowing therethrough from the extension 20 is deflected through an angle of approximately 90 degrees. Preferably, the curvature of the inner section 30 is slightly less than 90 degrees, on the order of 75 degrees to 85 degrees, to permit the operator to stand outwardly away from the plane of the gutter 14 during operation.

The terminal section 28 is attached to the end portion of the inner section 30 in a manner to tightly hold the two sections together, while permitting the terminal section 28 to be rotated relative to the inner section 30. In this instance, as best seen in FIGS. 4 and 5, an upper end portion 31 of the inner section 30 is telescoped inside an enlarged flange portion 32 of the terminal section 28 which includes an annular recess 34 receiving a mating raised annular rib 36 formed around the upper end portion 31 of the inner section 30. The recess 34 and rib 36 securely hold the inner section 30 and the terminal section 28 together, yet permit the terminal section 28 to be rotated relative to the inner section 30 about a generally horizontal axis with respect to the ground.

To direct the air flow from the inner section 30 into the trough 24 of the gutter 14, the terminal section 28 is curved and of relatively short length so that the elbow 26 can rest on the lip 22 in the area of the flange portion 32 during operation. Preferably, the curvature of the terminal section 28 is about 90 degrees. The terminal section 28 may include a reduced cross-sectional area in the form of a nozzle, which increases the velocity of the air directed into the trough 24.

In typical operation of an embodiment of the invention, as illustrated in FIG. 1, the operator first assembles the extensions 16, 18 and 20 to the air blower 12 and then assembles the elbow 26 to the uppermost extension 20. The number of extensions is selected to position the top of the uppermost extension 20 at approximately the same height or slightly below the height of the gutter lip 22, when the air blower 12 is held at a convenient height by the operator. The operator then rotationally positions the terminal section 28 in relation to the inner section 30 manually, so that the debris is blown to the left or to the right.

To remove leaves and debris from the gutter trough 24, the operator lifts and positions the blower attachment 10 so that the elbow 26 rests on the gutter lip 22, thereby orienting the terminal section 28 to direct air downwardly into the trough 24. The motor of the air blower 12 is then started, creating an air flow through the blower attachment 10. The operator stands to the side opposite the direction the debris is blown as the air flow lifts the debris from the trough 24.

To perform the cleaning operation, the operator slides the blower attachment 10 along the length of the gutter 14, lifting it slightly to avoid hitting any cross-member braces. The operator also may move the blower attachment 10 outwardly or inwardly to direct the flowing air into all portions of the gutter trough 24. Where necessary to direct the flowing air into a termination 38 or other location otherwise inaccessible with the first-selected rotational position of the terminal section 28, the operator may turn off the air blower 12, lower the blower attachment 10 to the ground, change the rotational positioning and resume the cleaning operation.

It will now be appreciated that, through the use of this invention, the relatively high-velocity air produced by the air blower 12 is directed by the blower attachment 10 into the gutter trough 24 to remove leaves and other debris. The elbow design allows the air flow to be adjustably directed into all portions of the gutter trough

BLOWER ATTACHMENT FOR CLEANING RAIN GUTTERS

BACKGROUND OF THE INVENTION

This invention relates generally to power air blower attachments, and more particularly, to an adjustable air blower attachment for safely cleaning out the gutters of buildings by directing a flowing stream of air from a source at ground level into the gutter trough to blow out leaves, twigs and other debris.

To collect rain water from their roofs, many buildings are provided with rain gutters, which are generally U-shaped channels formed from sheet metal. Rainwater striking the roof flows to the edge of the roof, enters the gutter through the uppermost open portion of the "U", collects in the lower closed portion of the "U", termed a gutter trough, and is conducted away by flow along the channel. A downspout communicates with the gutter trough to conduct the collected rainwater to ground level for disposal.

Provision is made on one leg of the "U" for mounting the gutter to the lower end of the eaves of the roof in a position to receive the rainwater, which would otherwise fall directly to the ground. At periodic intervals along the length of the gutter, crossmember braces are fixed between the leg of the "U" channel nearest the roof and the leg of the "U" channel remote from the roof, termed the gutter lip, to impart structural stiffness to the channel but no obstruct the flow of water into or along the channel.

A perennial problem for persons having houses or other buildings equipped with gutters is the cleaning of the gutter troughs, since, for the gutters and downspouts to perform their functions properly, they must be kept reasonably free of leaves, twigs, and other debris. Usually each autumn, and sometimes more frequently, the homeowner must clear accumulations of such material from the gutter troughs. The generally U-shaped configuration of a rain gutter makes the direct manual cleaning of its interior from ground level difficult, as the gutters for a single story building are typically approximately ten feet above ground level, and therefore cannot be reached directly.

In the past, several approaches for the cleaning of gutters have been taken. In one, the homeowner climbs a ladder, reaches into the gutter, grasps the debris, and places it into a bucket or drops it to the ground. This approach is potentially unsafe, since the ladder may stand on unfirm footing, and the climbing and descending of the ladder may itself be dangerous. Additionally, since the homeowner must periodically interrupt his cleaning to move the ladder along the length of the gutter, he is tempted to over-extend his reach and consequently risks losing his balance and falling from the ladder.

In a second conventional technique for cleaning gutters, the homeowner climbs to the roof and manually cleans the gutters. Since house roofs are generally down-sloping toward the gutters, and since during the cleaning operation the homeowner must reach forward and down the slope, he is typically in a precarious and unsafe position, thereby risking a fall.

The problems inherent in these conventional methods of cleaning gutters inhibit the homeowner from frequent cleaning of the gutters, so that gutters may fill with debris and become plugged, resulting in an undesirable overflow of rain water. Additionally, these conventional methods of cleaning pose significant safety hazards, since they must be performed from a position well above the ground. It is therefore desirable to develop an approach whereby the homeowner may safely and easily clean the gutters while standing on the ground.

One approach to the cleaning of gutters while standing at ground level is to use either a manual or motor driven brush mounted on the end of a pole of sufficient length and configuration to reach the interior of the gutter. Manual brushes are extremely tiring to use, and a motor-driven brush requires either the heavy weight of a motor at the top of an extension pole, or a complicated mechanical linkage if the motor is at the bottom of the pole. Moreover, brushes tend to pile up the debris without lifting it from the gutter. Brushes are also difficult to use in constricted areas and near the crossmember braces. Accordingly, there has been a need for a means to clean gutter troughs safely, efficiently and rapidly while the operator remains at ground level. The present invention fulfills this need.

SUMMARY OF THE INVENTION

The present invention provides an apparatus and method for cleaning leaves and other debris from a rain gutter by directing a stream of air, delivered to approximately the height of the gutter through a tubular extension connected to a hand-held air blower, over a lip of the gutter and downwardly into a gutter trough through a hollow tubular elbow. The adjustable elbow allows air to be directed against a mass of debris in the gutter trough at an effective angle, and further allows cleaning to proceed in either direction along the gutter. With this invention, an air blower that is readily available to many homeowners may be utilized so that a person standing at ground level may safely and efficiently remove debris from the gutters located many feet above the ground.

In accordance with the invention, air flows from the extension into an inner section of the elbow, which changes the direction of air flow into the horizontal plane so that it passes over the gutter lip. The air then flows into a terminal section of the elbow, which turns the air flow into the gutter trough so that the stream leaving the terminal section blows leaves, twigs and other debris from the gutter trough. The terminal section of the elbow is rotatable with respect to the inner section, and the relative angle of the exiting flow of air may be varied by rotating the terminal section, so that the operator may select the direction the debris is blown and the direction in which cleaning proceeds.

It will be appreciated from the foregoing that the present invention represents an advance in the practical utilization of portable air blowers. With this blower attachment, elevated gutters may be safely, efficiently and rapidly cleaned of leaves, twigs and other debris. The elbow configuration with a joint allowing rotational repositioning between the inner and terminal sections allows cleaning in both directions and easy access of the flowing air stream to corners and terminations in the gutter. The cleaning operation may be safely performed by an operator standing at ground level, thereby avoiding risks of falls from a ladder, and the leaves and other debris cleared from the gutter trough may be blown away from the operator.

Other features and advantages of the present invention will become apparent from the following more 24. The operator may accomplish the cleaning operation while standing on the ground, rather than on a ladder or the roof, thereby reducing any risk of a fall.

Although a particular embodiment of the invention is described in detail for purposes of illustration, various embodiments may be made without departing from the spirit and scope of the invention. Accordingly, the invention is not to be limited except as by the appended claims

I claim:

1. For use with a hand-held air blower, an attachment for cleaning out leaves, twigs and other debris from the trough of a rain gutter, comprising:

an extension for conducting the air flow from the air blower to approximately the height of the gutter;

an elbow to direct the air flow from said extension into the trough, said elbow including an inner section attached to said extension to conduct the air flow over the lip of the gutter, a terminal section to receive the air flow from said inner section and direct the air flow into the trough, and a joint allowing rotation between said inner section and said terminal section about an axis lying generally horizontal with respect to the ground, whereby the operator of the air blower may selectively direct the air flow to the left or to the right and set the downward inclination of the air flow into the trough by rotating the terminal section with respect to the inner section.

2. The apparatus of claim 1, wherein said terminal section is curved to deflect the air flow through about 90 degrees, and said inner section is curved to deflect the air flow through about 75 to about 85 degrees.

3. An improved attachment to a hand held air blower for cleaning out leaves, twigs and other debris from the trough of a rain gutter, said attachment having an extension for conducting the air flow from the air blower to approximately the height of the gutter and an elbow for directing the air flow from the extension into the trough, the improvement comprising:

a joint in said elbow, said joint dividing the elbow into an inner section attached to the extension to conduct the air flow over the lip of the gutter and a terminal section to receive the air from the inner section and direct the air flow into the trough, said joint allowing rotation between the inner section and the terminal section about an axis lying generally horizontal with respect to the ground, whereby the operator of the air blower may selectively direct the air flow to the left or to the right and set the downward inclination of the air flow into the trough by rotating the terminal section with respect to the inner section.

* * * * *